US006352302B1

(12) United States Patent
Piretti, Jr.

(10) Patent No.: US 6,352,302 B1
(45) Date of Patent: Mar. 5, 2002

(54) COMBINATION WORKSURFACE AND ARMREST FOR A SEATING UNIT

(75) Inventor: Giancarlo Piretti, Jr., Bologna (IT)

(73) Assignee: Pro-Cord S.r.l. (IT)

( * ) Notice: Subject to any disclaimer, the term of this patent is extended or adjusted under 35 U.S.C. 154(b) by 0 days.

(21) Appl. No.: 09/579,405

(22) Filed: May 25, 2000

Related U.S. Application Data

(60) Provisional application No. 60/137,684, filed on Jun. 4, 1999.

(51) Int. Cl.[7] ..... A47B 39/00

(52) U.S. Cl. ..... 297/160; 297/170; 297/172

(58) Field of Search ..... 297/135, 160, 297/161, 162, 170, 171, 172, 120, 411.27, 411.31, 411.37

(56) References Cited

U.S. PATENT DOCUMENTS

| | | | | | |
|---|---|---|---|---|---|
| 734,218 | A | * | 7/1903 | Bley | 297/170 X |
| 1,324,503 | A | * | 12/1919 | Hirsch | 297/170 X |
| 1,413,745 | A | * | 4/1922 | Leonard | 297/170 X |
| 3,717,375 | A | * | 2/1973 | Slobodan | 297/162 |
| 6,142,559 | A | * | 11/2000 | Sorel et al. | 297/170 X |

* cited by examiner

*Primary Examiner*—Laurie K. Cranmer
(74) *Attorney, Agent, or Firm*—Boyle, Fredrickson, Newhall, Stein & Gratz, S.C.

(57) ABSTRACT

A combination tablet and armrest assembly for a seating unit. The seating unit includes a seat portion and a back, and the combination tablet and armrest assembly includes a support member which is movable between an operative position toward the front of the seat portion, and an inoperative position toward the rear of the seat portion. The support member is preferably mounted for pivoting movement to a base member secured to the underside of the seat portion. A combination tablet/armrest member is mounted to the support member. The tablet/armrest member includes a stationary section mounted to the support member, and a pivotable section interconnected with the stationary section via a hinge. The sections of the tablet/armrest member are adapted to be folded together when the support member is in its inoperative rearward position, to function as an armrest. When the support member is in its operative forward position, the tablet/armrest member is unfolded such that coplanar surfaces of the tablet/armrest sections cooperate to define an upwardly facing tablet or worksurface spaced above the seat.

16 Claims, 6 Drawing Sheets

COMBINATION WORKSURFACE AND ARMREST FOR A SEATING UNIT

CROSS-REFERENCE TO RELATED APPLICATION

This application is based on provisional patent application Ser. No. 60/137,684, filed Jun. 4, 1999.

BACKGROUND AND SUMMARY OF THE INVENTION

This invention relates to furniture, and more particularly to a combination worksurface and armrest assembly for use with a seating unit.

In seating-type furniture, it is known to provide a tablet arrangement which is movable between a raised, operative position and a lowered, storage position. This type of tablet arrangement is commonly provided in auditorium-type seating, which typically includes an arm structure located at the side of each seating unit. The tablet member is typically mounted to the arm structure of the seating unit for movement between its raised, operative position and its lowered, storage position. Various mechanisms are known for providing movement of the tablet assembly between its raised, operative position and its lowered, storage position. Generally, tablet assemblies are limited to use in row-type multiple seating installations.

It is an object of the present invention to provide a tablet or worksurface assembly which is adapted to be used in a stand-alone seating unit. It is a further object of the invention to provide a stand-alone seating unit with a structure which is capable of being used either as an armrest or as a tablet. A still further object of the invention is to provide such a combination tablet and armrest assembly which can easily be moved between an operative position located above a seat portion of the seating unit, and an inoperative position adjacent the side of the seating unit. A still further object of the invention is to provide a structure which is capable of functioning both as an armrest at the side of the seating unit and as a tablet over the seat portion of the seating unit. Yet another object of the invention is to provide a combination tablet and armrest assembly which is relatively simple in its components and construction, yet which provides an efficient and effective arrangement for incorporating an armrest and worksurface into a stand-alone seating unit.

In accordance with the invention, a seating unit is provided with a combination tablet and armrest assembly. The seating unit includes a seat portion and a back portion, and the tablet and armrest assembly includes a base member secured to the seat portion and a support member movably mounted to the base for movement between a forward position and a rearward position. A tablet/armrest member is mounted to the support member. The support member and tablet/armrest member are configured such that the tablet/armrest member is located adjacent a side of the seat portion when the support member is in its rearward position, and is located over the seat portion when the support member is in its forward position. The tablet/armrest member functions as a tablet or worksurface when located over the seat portion, and as an armrest when located adjacent the side of the seat portion.

The tablet/armrest member includes first and second pivotably interconnected sections. The first and second sections are adapted to be folded together when the support member is in its rearward position, to enable the folded first and second sections to function as an armrest. The first and second sections are adapted to be unfolded when the support member is in its forward position. The first and second sections define substantially coplanar upwardly facing surfaces which cooperate to define a tablet or worksurface located over the seat portion when the support member is in its forward position.

The base member is preferably in the form of a base plate which is adapted to be secured to an underside of the seat portion of the seating unit. A pivot stud is secured to the base plate, and the support member is pivotably mounted to the pivot stud for movement about a pivot axis defined by the pivot stud.

The support member includes an upright portion which extends upwardly from a lower portion, and the lower portion of the support member is pivotably mounted to the pivot stud. A stop member is mounted to the base plate, and the lower portion of the support member is engageable with the stop member for defining the range of movement of the support member between its forward and rearward positions. Support structure is mounted to the base plate, and engages the lower portion of the support member for providing stability to the support member. The tablet/armrest member extends laterally from an upper end defined by the support member.

The invention also contemplates a method of assembly for a seating unit, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION

Figure 1:
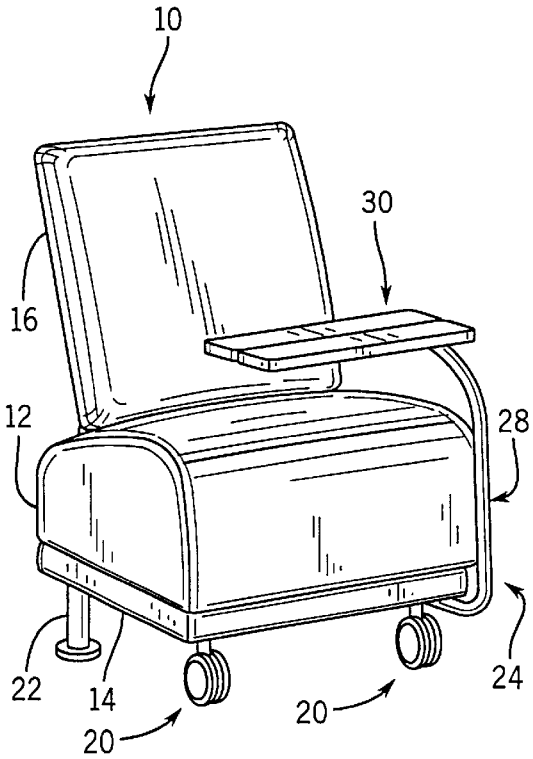
FIGS. 1 and 2 illustrate a seating unit incorporating a combination tablet and armrest assembly constructed according to the invention, with the tablet/armrest assembly located in an operative position over the seat in FIG. 1 and located in an inoperative position adjacent the side of the seat in FIG. 2.
Figure 2:
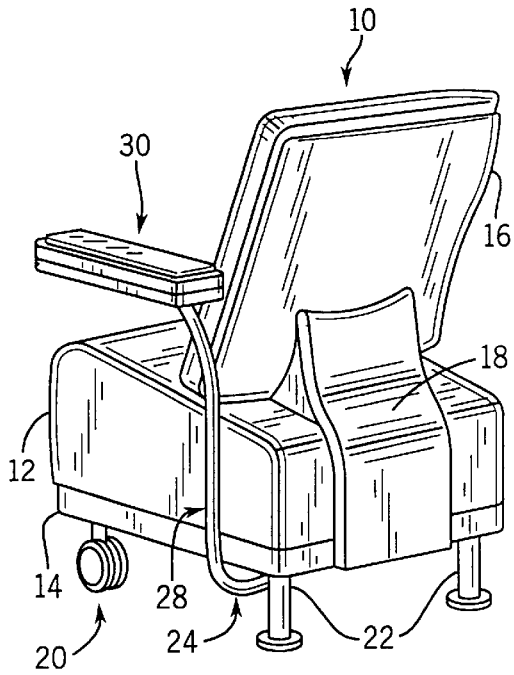
Figure 3:
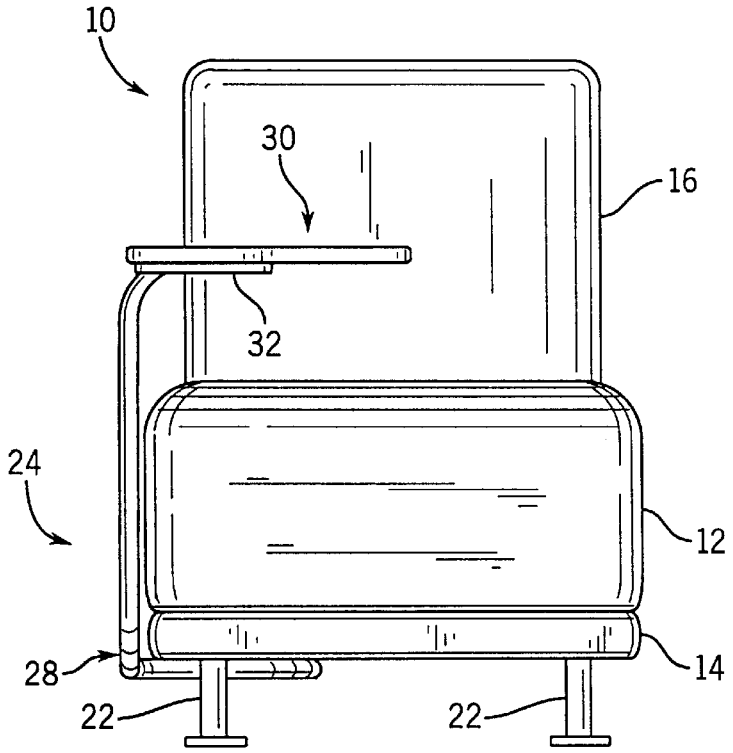
FIG. 3 is a front elevation view of a seating unit as illustrated in FIGS. 1 and 2, showing the combination tablet and armrest assembly in an operative position in front of a user and over the seat.
Figure 4:
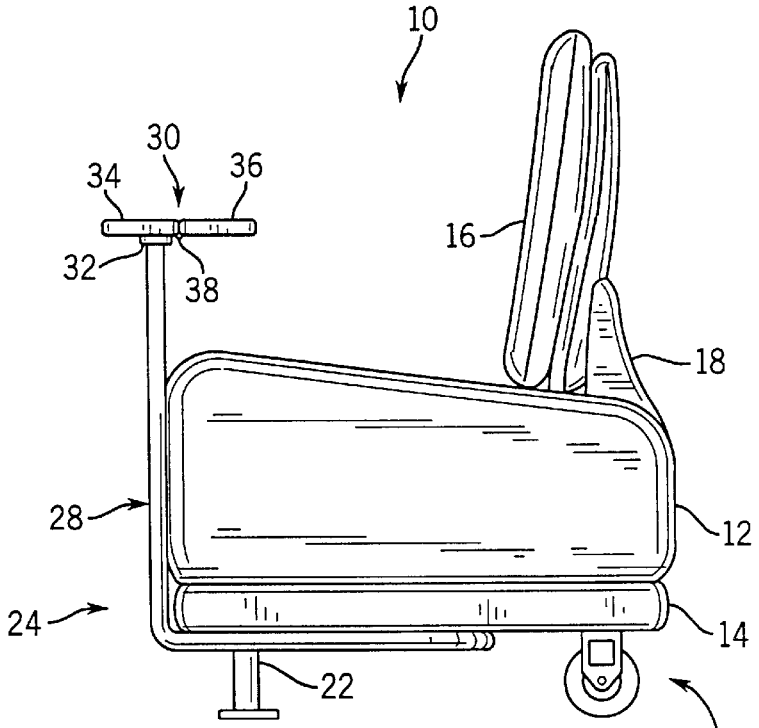
FIG. 4 is a side elevation view of the seating unit of FIGS. 1–3.

Referring to FIGS. 1 and 2, a seating unit 10 constructed according to the invention generally includes a seat 12 to which a base 14 is mounted. A back 16 extends upwardly from seat 12, and is mounted to base 14 by means of a back support 18. A pair of caster assemblies 20 are located at the front of base 14, and a pair of legs 22 are located at the rear of base 14. Caster assemblies 20 provide ease of movement of seating unit 10 on a supporting surface such as a floor. While caster assemblies 20 are illustrated at the front of seating unit 10 in FIGS. 1 and 2, it is understood that caster assemblies 20 could also be located at the rear of seating unit 10 as illustrated in FIGS. 3 and 4.

In accordance with the invention, an arm assembly 24 is mounted to base 14 of seating unit 10. Arm assembly 24 is movably mounted to base 14 for movement between an inoperative position as shown in FIG. 2 in which arm assembly 24 functions as an arm for seating unit 10, and an operative position as shown in FIG. 1 in which arm assembly 24 functions as a worksurface or tablet.

Generally, arm assembly 24 includes a base assembly 26 (FIG. 5), an upright 28 movably mounted to base assembly 26 in a manner to be explained, and a tablet/armrest 30 mounted to a plate 32 on the upper end of upright 28. When arm assembly 24 is in its inoperative position shown in of FIG. 2, upright 28 is located adjacent the side of seat 12 toward the rear of seat 12. While the drawings illustrate upright 28 at the left side of seat 12, it is understood that arm assembly 24 may also be constructed such that upright 28 is located at the right side of seat 12. Upright 28 is configured such that tablet/armrest 30 is located toward the side of seat 12 and extends in a forward-rearward direction when upright 28 is in its inoperative position.

When arm assembly 24 is in its operative position as illustrated in FIG. 1, upright 28 remains located at the side of seat 12 and is moved to the front of seat 12, to prevent obstruction of the leg area located forwardly of seat 12. Upright 28 is configured such that, in this position, tablet/armrest 30 is located forwardly of back 16 and extends transversely across seat 12 above the upper surface of seat 12. When arm assembly 24 is in its inoperative position, the longitudinal axis of tablet/armrest 30 is parallel to the longitudinal front-rear axis of seating unit 10, whereas tablet/armrest 30 is substantially perpendicular to the longitudinal front-rear axis of seating unit 10 when arm assembly 24 is in its operative position.

Figure 5:
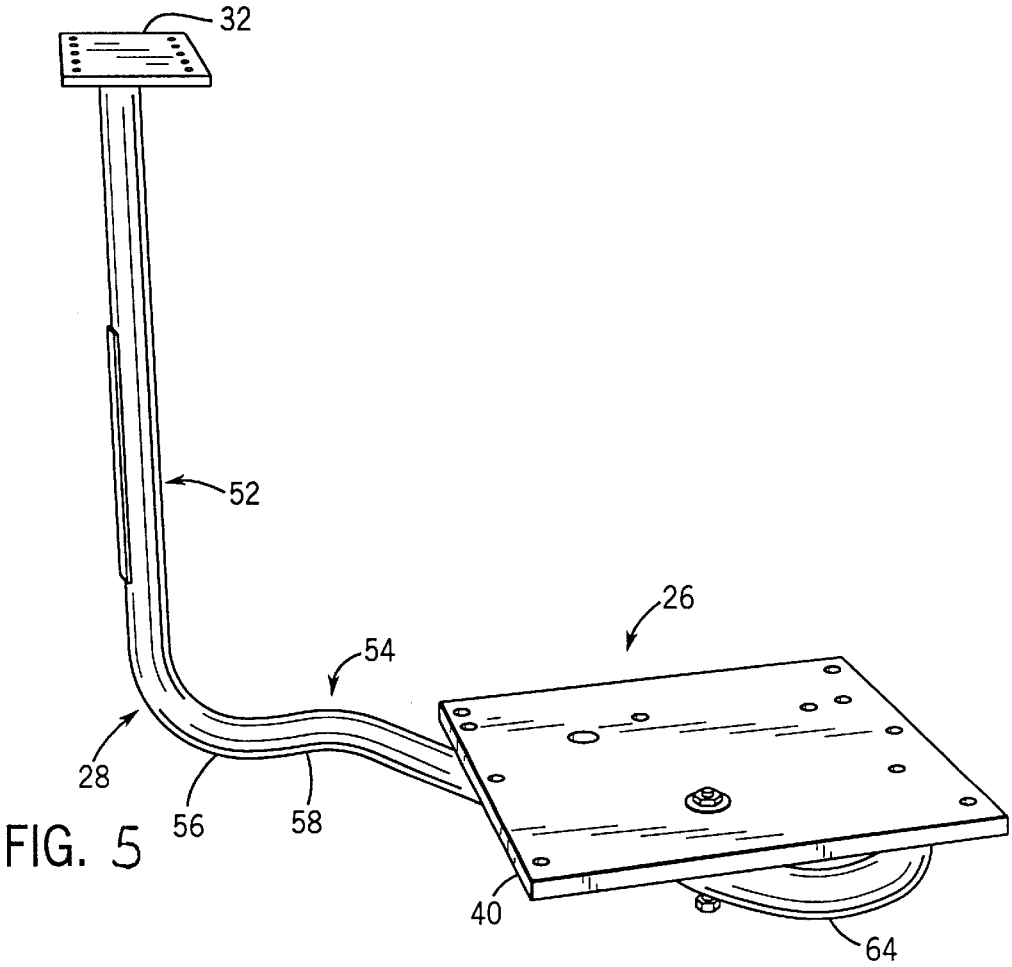
FIG. 5 is an isometric view illustrating the base member and the support member for using a part of the combination tablet and armrest assembly incorporated into the seating unit of FIGS. 1–3.

As shown in FIGS. 3–5, a mounting plate 32 is connected to the upper end of upright 28. Tablet/armrest 30 includes a stationary section 34 (FIG. 4) secured to mounting plate 32, and a movable section 36 pivotably mounted to stationary section 34 by means of a hinge 38 located therebetween. Movable section 36 is pivotable about hinge 38 between an unfolded position as shown in FIGS. 3 and 4 in which tablet/armrest 30 functions to provide a tablet or worksurface defined by coplanar upwardly facing surfaces of stationary section 34 and movable section 36, and a folded position as shown FIG. 2 in which movable section 36 is folded onto stationary section 34. Movement of movable section 36 to its folded position results in engagement of the surfaces of stationary and movable sections 34, 36, respectively, which face upwardly when movable section 36 is in its unfolded position of FIGS. 3 and 4. In a preferred form, a cushioning material is provided on the surface of movable section 36 which faces upwardly when movable section 36 is in its folded position.

Figure 6:
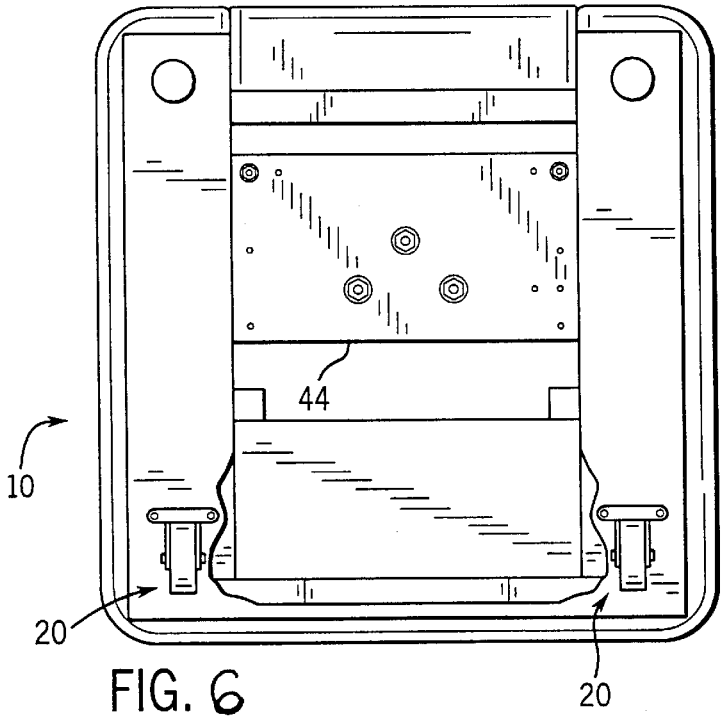
FIG. 6 is a view of the bottom of the seating unit of FIGS. 1–4, showing the area of the seating unit to which the base member of FIG. 5 is mounted.
Figure 7:
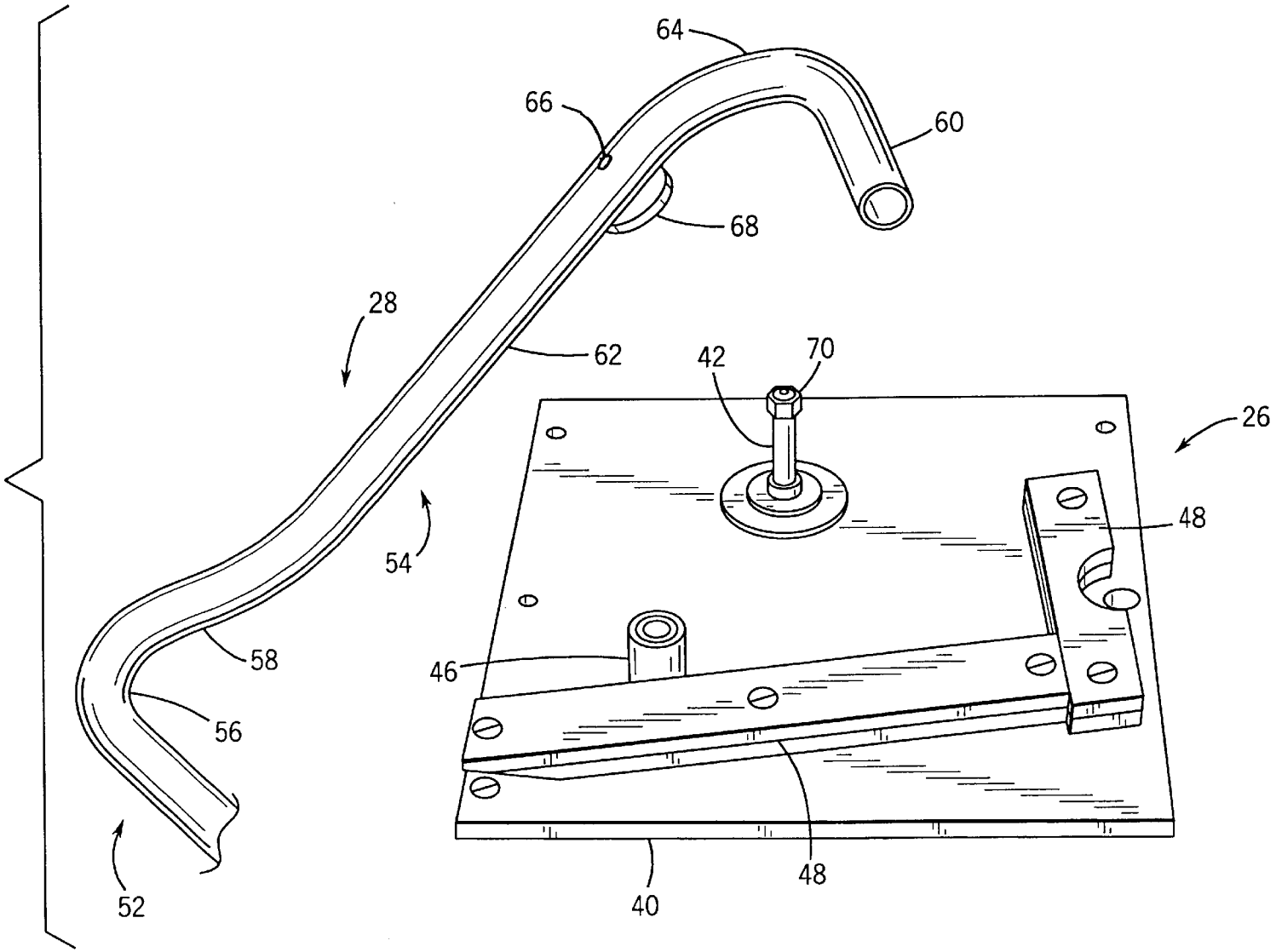
FIG. 7 is an isometric view illustrating the disassembled base member and support member and armrest assembly of FIG. 5.

FIG. 7 illustrates base assembly 26 and upright 28 in an upside down fashion and disassembled from seating unit 10. As shown in FIG. 7, base assembly 26 includes a base plate 40 and a pivot stud 42 which extends perpendicularly from base plate 40. Base plate 40 is adapted for mounting to the underside of base 14. Representatively, base plate 40 may be secured to a mounting plate 44 (FIG. 6) secured to the underside of base 14. When base plate 40 is secured to base 14 in this manner, pivot stud 42 extends downwardly from base plate 40 into the space between the underside of base 14 and the floor on which seating unit 10 rests.

Base assembly 26 further includes a stop member 46 (FIGS. 7–9) which extends downwardly from the lower surface of base plate 40. A pair of support bars 48 are mounted to the underside of base plate 40 and are oriented perpendicularly to each other.

Referring to FIGS. 5 and 7, upright 28 includes a vertical section 52 interconnected with a lower horizontal section 54 via a bend 56. Horizontal section 54 includes an outer section 58 located adjacent bend 56, and an inner section 60 located at the opposite end of horizontal section 54 from outer section 58. An angled intermediate section 62 extends inwardly from outer section 58, and is interconnected with inner section 60 via a bend 64. Outer section 58 and inner section 60 are substantially perpendicular to each other.

A vertical passage 66 (FIG. 7) is formed in intermediate section 62 adjacent bend 64. Passage 66 is in the form of aligned openings formed in the tubular wall of intermediate section 62. A circular bearing member 68 is mounted to the upper surface of intermediate section 62, and passage 66 extends through bearing member 68.

Figure 8:
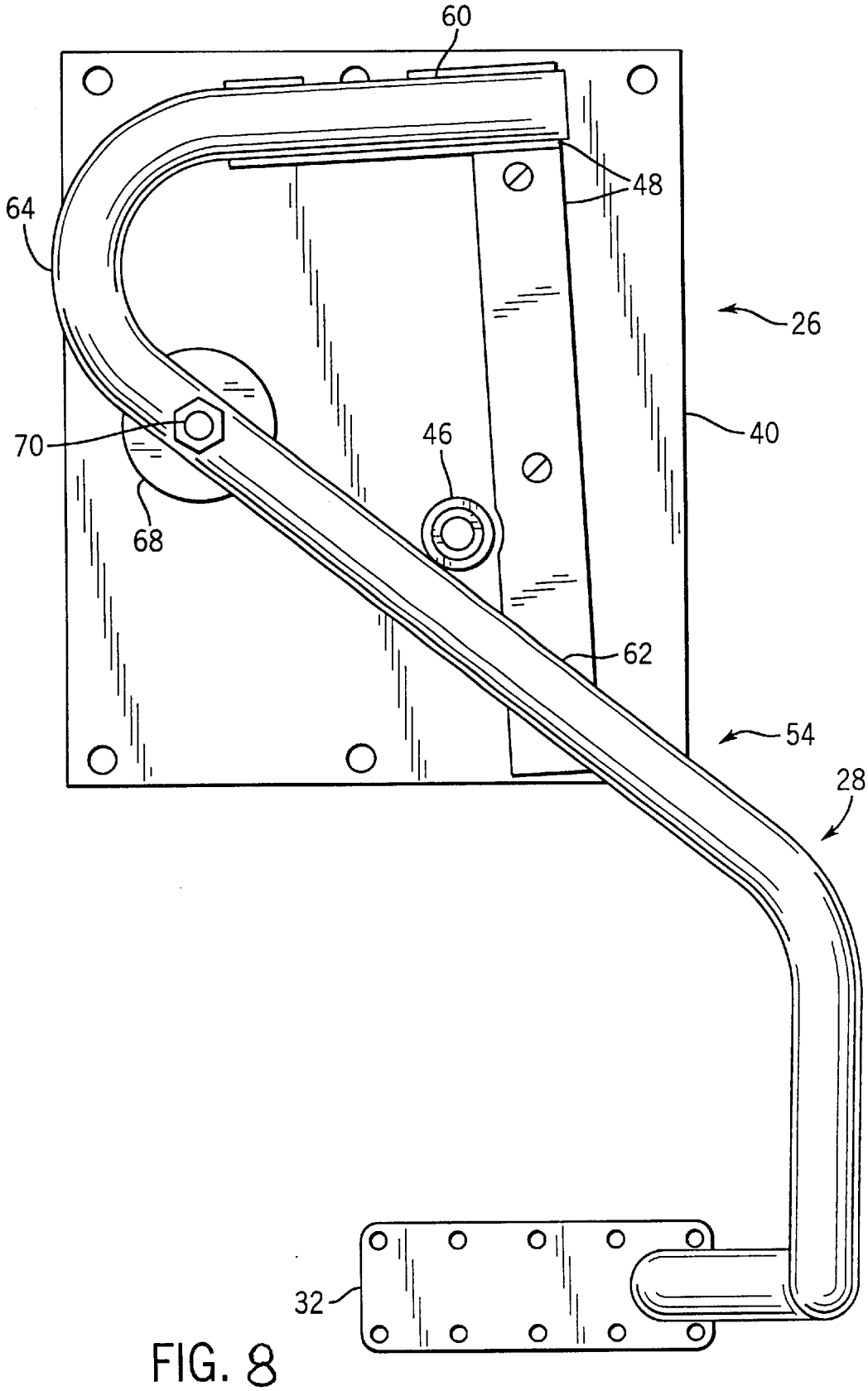
FIG. 8 is a bottom plan view showing the components of FIG. 7 assembled and in an inoperative position in which the combination tablet and armrest assembly functions as an armrest.
Figure 9:
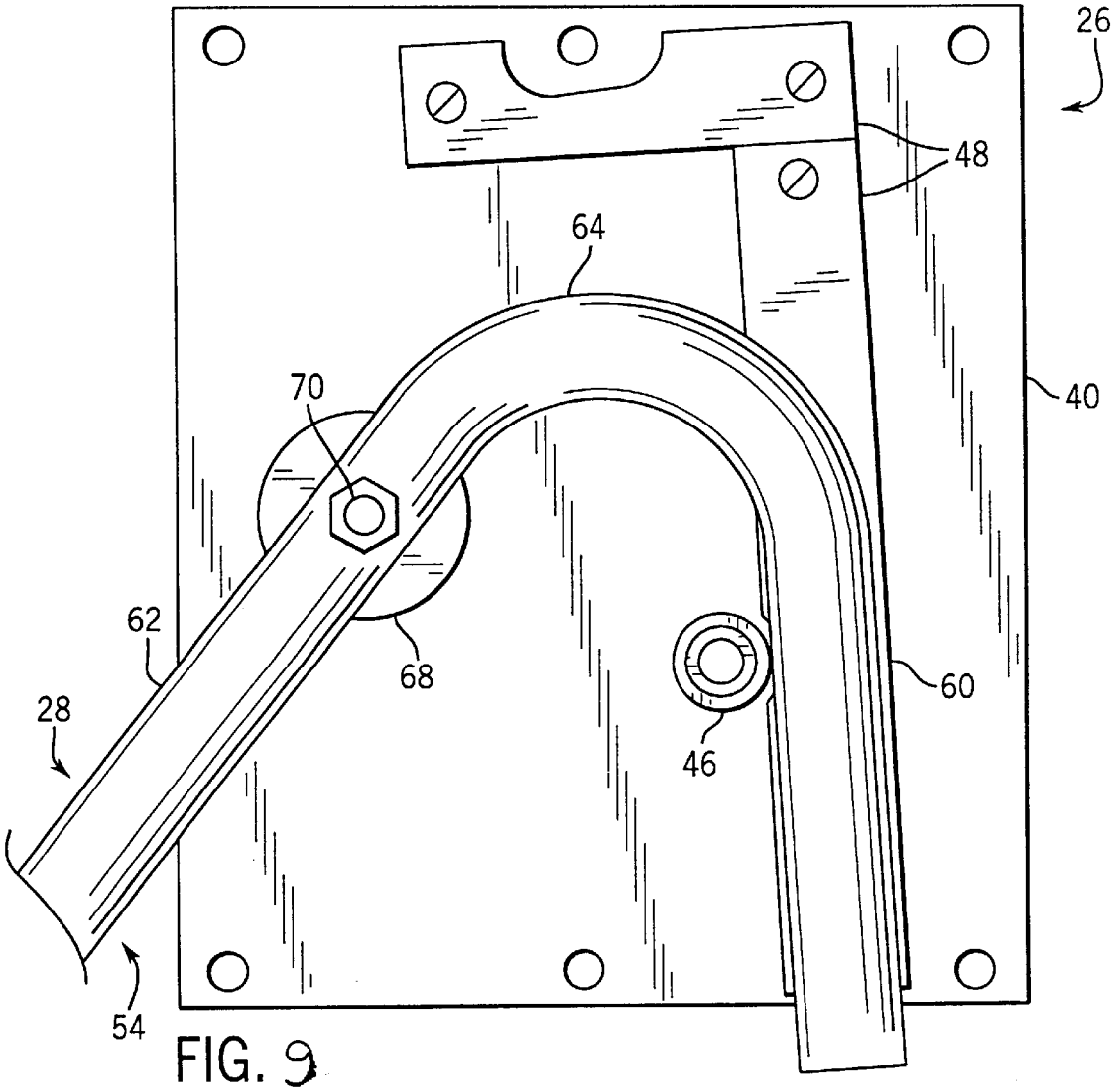
FIG. 9 is a view similar to FIG. 8, showing the assembled components of FIG. 5 in an operative position in which the combination tablet and armrest assembly functions as a worksurface.

As shown in FIGS. 8 and 9, upright 28 is mounted to base plate 40 by passing pivot stud 42 through opening 66, such that the longitudinal axis of pivot stud 42 defines a vertical pivot axis about which upright 28 is pivotable. The lower end of pivot stud 42 is threaded, and is adapted to receive a nut 70 which functions to secure upright 28 to base assembly 26 as shown in FIGS. 8 and 9.

In operation, upright 28 is pivotable relative to base plate 40 for movement between the forward and rearward positions illustrated in FIGS. 1 and 2, for moving tablet/armrest 30 between its operative and inoperative positions. FIG. 8 illustrates the position of horizontal section 54 of upright 28 when upright 28 is in its retracted rearward position shown in FIG. 2, and FIG. 9 shows the position of horizontal section 54 of upright 28 when upright 28 is in its extended forward position shown in FIG. 1.

As shown in FIG. 8, upright 28 is pivoted rearwardly about pivot stud 42 such that intermediate section 62 of upright horizontal section 54 engages stop member 46. In this manner, stop member 46 functions to limit the rearward pivoting movement of upright 28 relative to base assembly 26. When upright 28 is moved to its extended forward position, inner section 60 of upright horizontal section 54 engages stop member 46 so as to limit the forward pivoting movement of upright 28 relative to base assembly 26. In this manner, stop member 46 functions to engage different parts of horizontal section 54 so as to limit the range of movement of upright 28 relative to base assembly 26.

The upper surface of bearing member 68 engages the surface of base plate 40, so as to stabilize upright 28 during pivoting movement relative to base assembly 26. In addition, support bars 48 are positioned so as to maintain engagement with inner section 60 of upright horizontal section 54 throughout the range of movement of horizontal section 54 relative to base assembly 26, so as to provide added stability to upright horizontal section 54 and to relieve stresses which otherwise may be experienced by pivot stud 42 when a load is placed on tablet/armrest 30.

Various alternatives and embodiments are contemplated as being within the scope of the following claims particularly pointing out and distinctly claiming the subject matter regarded as the invention.

I claim:

1. An arm assembly for a chair, comprising:

a base adapted for mounting to the chair;

a support member movably mounted to the base for movement between an extended, operative position and a retracted, storage position, wherein the support member defines an upper end and is movably mounted to the base at a mounting area located below the upper end, and wherein the support member has a laterally offset configuration between the upper end and the mounting area such that movement of the support member between its extended, operative position and its retracted, storage position is operable to alter the position of the upper end of the support member relative to the mounting area; and a combination tablet and armrest member secured to the upper end defined by the support member, wherein the tablet and armrest member is adapted to function as an armrest when the support member is in its retracted, storage position, and to function as a worksurface when the support member is in its extended, operative position.

2. The arm assembly of claim 1, wherein the mounting area of the support member is pivotably mounted to the base, and wherein the offset configuration of the support member is defined by an upright portion of the support member which is laterally offset from the mounting area of the support member.

3. The assembly of claim 2, wherein the support member is configured so as to position the tablet and armrest member adjacent a side of the chair when the support member is in its retracted, storage position and over a seat portion of the chair when the support member is in its extended, operative position.

4. The arm assembly of claim 1, wherein the combination tablet and armrest member is foldable, and is adapted to be folded to function as an armrest and to be unfolded to function as a worksurface.

5. A seating unit, comprising:

a seat defining a pair of sides and an upwardly facing seating surface;

a support member pivotably mounted to the seat in a fixed position, wherein the support member includes an offset arrangement and is movable between a forward position and a rearward position; and a combination tablet and armrest member mounted to the support member, wherein the offset arrangement of the support member is configured such that the tablet and armrest member is located adjacent a side of the seat when the support member is in its rearward position and is located over the upwardly facing seating surface when the support member is in its forward position, wherein the tablet and armrest member functions as a worksurface when located over the seating surface and as an armrest when located adjacent the side of the seat.

6. The seating unit of claim 5, wherein the tablet and armrest member comprises first and second sections, wherein the first section is secured to an upper end defined by the support member and wherein the second section is pivotably mounted to the first section.

7. The seating unit of claim 6, wherein the second section of the tablet and armrest member is adapted to be folded onto the first section for enabling the first and second sections to function as an armrest, and wherein the second section is pivotable away from the first section to an unfolded condition when the support member is in its forward position wherein, when the second section is in the unfolded condition, the first and second sections define substantially coplanar upwardly facing surfaces which cooperate to define a worksurface located over the seat when the support member is in its forward position.

8. The seating unit of claim 5, wherein the offset arrangement of the support member is defined by an upright portion of the support member, to which the combination tablet and armrest member is mounted, together with a laterally extending mounting portion extending from the upright portion, wherein the mounting portion is pivotably mounted to the seat for movement about a pivot axis which is laterally spaced from the upright portion.

9. The seating unit of claim 8, wherein the support member is pivotably mounted to the seat by means of a base assembly secured to the seat, for movement between its forward and rearward positions.

10. A seating unit, comprising:

a seat defining a forward portion and a rearward portion;

a back extending upwardly from the seat toward the rearward portion of the seat;

a support member movably mounted to the seat for movement between a forward position and a rearward position; and a tablet/armrest member mounted to the support member, wherein the support member and tablet/armrest member are configured such that the tablet/armrest member is located adjacent a side of the seat when the support member is in its rearward position and is located over the seat when the support member is in its forward position, such that the tablet/armrest member functions as a worksurface when located over the seat and as an armrest when located adjacent the side of the seat;

wherein the support member is pivotably mounted to a base assembly secured to the seat for movement between its forward and rearward positions, wherein the base assembly comprises a base plate adapted for securement to an underside defined by the seat, and a pivot stud secured to the base plate and defining a pivot axis about which the support member is pivotable.

11. The seating unit of claim 10 wherein the pivot stud extends from the base plate and defines a substantially vertical axis about which the support member is pivotable.

12. The seating unit of claim 11 wherein the base assembly further includes a stop member, and wherein the support member is engageable with the stop member for defining the range of movement of the support member between its forward and rearward positions.

13. The seating unit of claim 12 wherein the support member comprises an upright portion extending upwardly from a lower portion, wherein the lower portion is pivotably mounted to the pivot stud and defines surfaces which engage the stop member for defining the range of pivoting movement of the support member.

14. The seating unit of claim 13 wherein the base assembly further includes support structure for engaging the lower portion of the support member for providing stability to the support member upon application of a load to the tablet/armrest and for stabilizing the support member during pivoting movement between its forward and rearward positions.

15. A method of assembly for a seating unit, comprising the steps of:

providing a seating unit having a seat;

securing a fixed-position base member to the seating unit;

pivotably mounting a support member to the base member for movement about an upright pivot axis, wherein the support member includes an upright section spaced laterally from the pivot axis, wherein pivoting movement of the support member causes the upright section to move between a forward position and a rearward position relative to the seat;

wherein the upright section of the support member is adapted to support a tablet/armrest member above the seat, and wherein the support member is configured such that movement of the upright section to its forward position functions to locate the tablet/armrest member over the seat, and movement of the upright section to its rearward position functions to locate the tablet/armrest member adjacent a side of the seat.

16. The method of claim 15, wherein the tablet/armrest member includes a first section secured to an upper end defined by the upright section of the support member, and a second section pivotably mounted to the first section for movement between a folded condition in which the first and second sections function as an armrest when the upright section of the support member is in its rearward position, and an unfolded condition such that coplanar upwardly facing surfaces defined by the first and second sections function to form a worksurface over the seat when the upright section of the support member is in its forward position.

* * * * *

UNITED STATES PATENT AND TRADEMARK OFFICE

CERTIFICATE OF CORRECTION

PATENT NO. : 6,352,302 B1
DATED : March 5, 2002
INVENTOR(S) : Giancarlo Piretti

It is certified that error appears in the above-identified patent and that said Letters Patent is hereby corrected as shown below:

Title page,
Item [75], Inventor: please delete ", Jr."
Item [56], References Cited, please insert the following references:

| | | |
|---|---|---|
| -- 534,469 | 2/1895 | Demarest |
| 3,174,795 | 11/1997 | Chapman et al. |
| 3,353,866 | 11/1967 | Chapman et al. |
| 3,479,084 | 11/1969 | Van Ryn |
| 3,547,488 | 12/1970 | Barnes |
| 3,556,588 | 11/1997 | Monyer et al. |
| 4,944,552 | 7/1990 | Harris |
| 5,087,096 | 2/1992 | Yamazaki |
| 5,683,136 | 11/1997 | Baumann et al. -- |

Column 6,
Line 45, after "10" insert -- , --;
Line 48, after "11" insert -- , --;
Line 53, after "12" insert -- , --;
Line 59, after "13" insert -- , --;

Signed and Sealed this

Seventeenth Day of September, 2002

*Attest:*

*Attesting Officer*

JAMES E. ROGAN
*Director of the United States Patent and Trademark Office*